United States Patent [19]

James

[11] 4,397,383

[45] Aug. 9, 1983

[54] ESCALATOR SAFETY INSERT

[76] Inventor: Robert B. James, 41 Dallington Dr., Willowdale, Ontario, Canada, M2J 2G4

[21] Appl. No.: 262,320

[22] Filed: May 11, 1981

[51] Int. Cl.[3] ..... B66B 9/12

[52] U.S. Cl. ..... 198/333

[58] Field of Search ..... 198/333, 326, 324, 325

[56] References Cited

U.S. PATENT DOCUMENTS 4,236,623 12/1980 Ackert ..... 198/333

OTHER PUBLICATIONS

Mechanical Behavior of Engineering Materials by Conway & Queeney Dept. Eng. Sci. & E. Mch., Penn St. U. Jan. 1979, pp. 25–27.

*Primary Examiner*—Robert C. Watson
*Assistant Examiner*—Douglas D. Watts
*Attorney, Agent, or Firm*—Sim & McBurney

[57] ABSTRACT

There is provided a safety insert for use on an escalator having moving steps, each of which defines at the top a plurality of upstanding, spaced-apart teeth separated by a plurality of grooves, the escalator including a side skirt closely adjacent the sides of the steps. The safety insert is of a resilient material, and is a one-piece, elongated member of constant section. The section includes a lower portion which is sized and shaped so as to be receivable snugly within the furthest sideward groove in a step, and also includes an upper portion which extends above the tops of the teeth when the lower portion is received in its groove. The upper portion projects obliquely upwardly and sidewardly from the lower portion, and terminates in an abutment region which, which the lower portion is received within its groove, is spaced inwardly from the escalator side skirt and spaced above the tooth immediately outward of the groove in which the lower portion is received.

6 Claims, 2 Drawing Figures

ESCALATOR SAFETY INSERT

This invention relates generally to escalators, and has to do particularly with an escalator safety insert adapted to be applied along the side of an escalator step, in order to minimize the risk that a passenger on the escalator may have his shoe trapped between the escalator step and the side skirt of the escalator passageway.

BACKGROUND OF THIS INVENTION

There have been a number of recent "accidents" involving escalators, in which a passenger on the escalator has had his shoe or boot become trapped between the moving escalator step and the stationary side skirt defining the side walls of the escalator passageway. These accidents usually arise when the passenger, wearing footwear which has a rubber sole, places his foot down on the escalator step over at the side, so that part of the sole projects beyond the side of the escalator step and comes into frictional contact with the side skirt of the escalator passageway. As the escalator step moves upwardly with respect to the side skirt, there is a "snubbing" action which attempts to draw the edge of the sole of the shoe down into the crack between the escalator step and the side skirt. This can result in serious damage to the foot of the person becoming so entrapped, and escalator owners have been sued for damages in connection with some of these accidents.

In order to minimize or eliminate the risk of such shoe entrapment on escalators, certain approaches have been utilized, which form part of the prior art.

One approach involves re-designing the escalator step itself, so that the outside upstanding teeth are raised higher than the remaining teeth in the middle portion of the escalator step. It is well known that escalator steps are defined at their top surface by a plurality of upstanding, parallel teeth in a comb-like arrangement, all running parallel to the direction in which the escalator is moving. This allows a structure at the top and bottom of the escalator which ensures that there will be no entrapment of shoes or the like at the top and bottom where the escalator step disappears under the main floor. The normal construction involves a comb-like scouring unit which has downwardly projecting teeth extending into the spaces or grooves between the upstanding teeth on the escalator step.

While the approach previously mentioned, that of raising the outside one or two escalator teeth to a level above the rest of the teeth, is found to work satisfactorily in many cases, it does not provide a solution for the existing escalator installations. The effectiveness of this prior art approach is to make it uncomfortable for the passenger to leave his foot on the raised teeth, thus prompting him automatically to move the foot inwardly away from the side skirt.

Another approach to this problem is exemplified in U.S. Pat. No. 4,236,623, issued on Dec. 2, 1980 to Duane B. Ackert. This patent relates to inserts adapted to be interfitted with the outside one or two upstanding teeth of an escalator step, in order to provide a raised region which will prompt a passenger to remove his foot from the side area. However, this prior art insert device is complex and utilizes a considerable amount of material. Moreover, it does not include the capability of allowing the release of a passenger's shoe if that shoe should in fact become caught between the insert and the side skirt.

GENERAL DESCRIPTION OF THIS INVENTION

In view of the foregoing disadvantages of the prior art approaches to solving the problems set out earlier, it is an aspect of this invention to provide a safety insert for an escalator step, which is of simplified construction while maintaining its effectiveness, and which in particular is such as to allow the passenger's foot to be released if it should accidentally become caught between the insert and the side skirt.

Accordingly, this invention provides a safety insert for use on an escalator having moving steps, each defined at the top by a plurality of upstanding, spaced-apart teeth separated by a plurality of grooves, and a side skirt closely adjacent the sides of the steps. The safety insert of this invention is of resilient material, and is a one-piece elongated member of constant section. The section includes a lower portion sized and shaped so as to be receivable snugly within the furthest sideward groove in an escalator step, and an upper portion located above the plane of the tops of the teeth when the lower portion is received in its groove. The upper portion of the section projects in cantilevered fashion obliquely upwardly and sidewardly from the lower portion, in such a way that it is out of contact with the tooth immediately outward of the groove in which the lower portion is received, and terminates in an abutment region which, when the lower portion is received within its groove, is spaced inwardly from the escalator side skirt and is spaced above the tooth immediately outward of the groove in which the lower portion is received.

The junction between the upper and lower portions is shaped to define a stress-reducing, rounded, S-shaped contour located along the outward margin under the upper portion, so as to permit substantial flexure of the upper portion under the weight of a passenger's shoe.

GENERAL DESCRIPTION OF THE DRAWINGS

One embodiment of this invention is illustrated in the accompanying drawings, in which like numerals denote like parts throughout the several views, and in which:

FIG. 1 is a cross-sectional view, to a scale larger than its actual size, of an escalator safety insert constructed in accordance with this invention; and FIG. 2 is a partly broken away and partly sectioned perspective view of the escalator safety insert of this invention, installed in an escalator step.

DETAILED DESCRIPTION OF THE DRAWINGS

Figure 2:
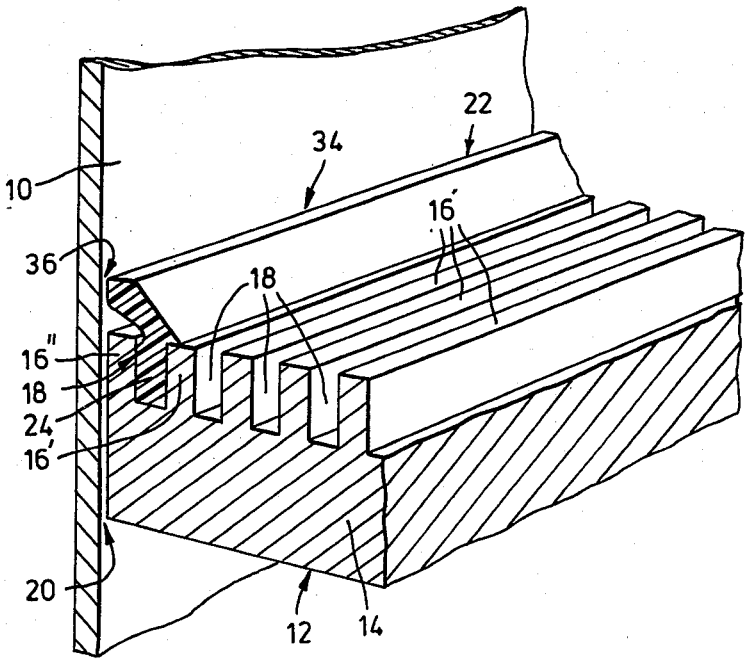

Attention is first directed to FIG. 2, in which are shown those parts of an escalator which are essential for an understanding of the function and position of the safety insert of this invention. In FIG. 2 a side skirt 10 of an escalator is illustrated in a substantially vertical position, and an escalator step 12 is shown. Both the side skirt and the escalator step have been sectioned along a vertical plane transverse to the direction of movement of the escalator step (which is along a direction parallel to the side skirt 10), in order to show the various spacings of the major components.

As can be seen in FIG. 2, the escalator step 12 has a main portion 14, from which a plurality of upstanding teeth 16 extend. Each of the teeth 16 is substantially rectangular in cross-section, and they are spaced apart by grooves 18 which are also of rectangular section.

The outside tooth has been labelled as 16'', while the next inward tooth has been labelled as 16'. It can be seen in FIG. 2 that a small spacing 20 exists between the outside tooth 16'' and the side skirt 10 of the escalator, the spacing 20 being provided to ensure that the escalator step will not rub or chafe against the side skirt 10.

Into the groove 18 between the teeth 16' and 16'' is placed an escalator safety insert identified by the numeral 22.

Figure 1:
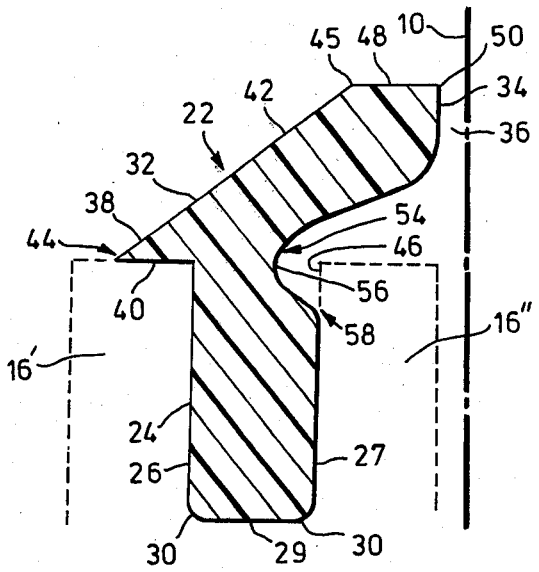

Referring to FIGS. 1 and 2 simultaneously, the safety insert 22 is seen to be a one-piece, elongated member of constant section. The section includes a lower portion 24 which is sized and shaped so as to be receivable snugly within the groove 18' between the teeth 16' and 16'', i.e. the furthest sideward groove in the step 12. More particularly, the lower portion 24 is substantially rectangular, as are the grooves 18, and in particular its width, i.e. the distance between side walls 26 and 27, is made to be such that it can be force-fitted into the groove 18', and such that, once in place, it cannot be easily removed due to friction. As seen in FIG. 1, the lower portion 24 has a bottom wall 29, and rounded lower corners 30.

The section shown in FIG. 1 also includes an upper portion 32 which extends above the tops of the teeth 16 when the lower portion 24 is received in the groove 18', as can be seen in FIG. 2. In a general way, the upper portion 32 projects obliquely upwardly and sidewardly from the lower portion 24, the term "sidewardly" referring to the direction toward the side skirt 10 of the escalator. Also as seen in both figures, the upper portion 32 terminates in an abutment surface 34 which, when the lower portion 24 is received within its groove 18', is spaced inwardly from the escalator side skirt 10 by a spacing 36, and is spaced above the tooth 16'' immediately outward of the groove 18' in which the lower portion 24 is received.

As best seen in FIG. 1, the upper portion 32 includes an overlapping part 38 which tapers inwardly (i.e. away from the escalator side skirt 10) and which overlies part of the tooth 16' which is immediately inward of the groove 18' in which the lower portion 24 is received.

More specifically, the upper portion 32 has a flat horizontal wall 40 which is adapted to contact and overlie part of the tooth 16' which is immediately inward of the groove 18' in which the lower portion 24 is received, and has also an oblique wall 42 which slopes from an acute-angled junction 44 with the flat wall 40 up to a location 45 generally above the inward edge 46 of the tooth 16'' which is immediately outward of the groove 18' in which the lower portion 24 is received. From the location 45, a horizontal top wall 48 extends outwardly to a corner 50, and then the vertical surface 34 extends downwardly.

The section of the insert shown in FIG. 1 includes a stress-reducing contour generally at the junction between the upper portion 32 and the lower portion 24. More specifically, the contour is a rounded contour 54 located along the outward margin of the section underneath the upper portion 32, i.e. along an extension of the side edge 27 of the lower portion 24.

Even more particularly, the stress-reducing contour 54 extends from the upper outer extremity of the upper portion 32 (namely the vertical surface 34), proceeds downwardly and away from the side skirt 10, then curves around to define a rounded indentation 56 which extends inwardly of the inward edge 46 of the tooth 16'' immediately outward of the groove 18' in which the lower portion 24 is received. Then, the contour merges smoothly at 58 with the outside wall 27 of the lower portion 24.

The safety insert herein disclosed is made of a resilient material, and is designed with the stress-reducing contour 54, for two important reasons: The first reason is to allow the upper portion 32 to resiliently deflect downwardly under the weight of the shoe of a passenger on the escalator, without breaking. The second reason is to permit flexure of the join between the upper portion 32 and the lower portion 24 of the insert, in the case where the shoe of an escalator passenger becomes entrapped between the abutment region 34 and the side skirt 10 of the escalator. Naturally, if such entrapment should occur, the passenger will become immediately aware that his foot is becoming entrapped, even before the sole or adjoining region of the shoe gets close to the outermost tooth 16''. The natural reaction of the passenger is of course to yank his foot away from the location of entrapment, and this force will cause the region of the stress-reducing contour 54 to flex sufficiently to free the entrapped foot. This procedure will take place before the shoe contacts the outermost tooth 16'', and therefore there will be no risk of the far more serious entrapment that could conceivably take place between the side skirt 10 and the outermost tooth 16''.

Naturally, one of the foremost advantages of the insert of this invention is that it is directly and immediately applicable to existing escalator installations, and does not require the escalator steps to be replaced with re-designed steps.

In an alternative embodiment, the material of the insert may be made of resilient and frangible material so that, as a last resort, the upper portion 32 will break away from the lower portion 24 to free a trapped foot, the rupture occurring in the region of the contour 54.

Among the satisfactory materials from which the insert may be made are: PVC and Nylon (trade mark).

While a specific embodiment of this invention has been described in the foregoing disclosure, it will be apparent to those skilled in the art that changes and modifications may be made with respect thereto, without departing from the essence and scope of the invention as defined in the appended claims.

What is claimed is:

1. For use on an escalator having moving steps, each defined at the top by a plurality of upstanding, spaced-apart teeth separated by a plurality of grooves, and a side skirt closely adjacent the sides of the steps: a safety insert of resilient material, the inserting being a one-piece, elongated member of constant section, the section comprising:

a lower portion sized and shaped so as to be receivable snugly within the furthest sideward groove in a step, and an upper portion located above the plane of the tops of the teeth when the lower portion is received in its groove, the upper portion projecting in cantilevered fashion obliquely upwardly and sidewardly from the lower portion, in such a way that it is out of contact with the tooth immediately outward of the groove in which the lower portion is received, the upper portion terminating in an abutment region which, when the lower portion is received within its groove, is spaced inwardly from the escalator side skirt, and is spaced above the tooth immediately outward of the groove in which the lower portion is received, the junction between the upper and lower portions being shaped to define a stress-reducing, rounded, S-shaped contour located along the outward margin under the upper portion, so as to permit substantial flexure of the upper portion under the weight of a passenger's shoe.

2. The invention claimed in claim 1, in which the lower portion is substantially rectangular, the upper portion having an overlapping part which tapers inwardly and overlies part of the tooth immediately inward of the groove in which the lower portion is received.

3. The invention claimed in claim 1, in which the upper portion has a flat wall adapted to contact and overlie part of the tooth immediately inward of the groove in which the lower portion is received, an oblique wall sloping from an acute-angled junction with said flat wall to a location generally above the inward edge of the tooth which is immediately outward of the groove in which the lower portion is received, and a stress-reducing contour from the upper outer extremity of said upper portion, said contour proceeding downwardly and away from the side skirt, then curving around to define a rounded indentation extending inwardly of the inward edge of the tooth immediately outward of the groove in which the lower portion is received, then merging smoothly with the outside wall of the lower portion.

4. The invention claimed in claim 1, in which the stress-reducing contour also provides a region of least section between the upper and lower portions, thus providing a location where flexure can occur under stress.

5. The invention claimed in claim 1, in which the insert is made of PVC.

6. The invention claimed in claim 1, in which the insert is made of Nylon (trade mark).

* * * * *